United States Patent [19]

Johnson

[11] 4,253,444

[45] Mar. 3, 1981

[54] ELECTRIC FURNACE FIREPLACE

[76] Inventor: Richard Johnson, 1545 W. Pekin Rte.#2, Lebanon, Ohio 45036

[21] Appl. No.: 906,824

[22] Filed: May 17, 1978

[51] Int. Cl.[3] ..... F24C 1/14; F27D 11/00

[52] U.S. Cl. ..... 126/6; 126/121; 219/279; 237/51

[58] Field of Search ..... 126/121, 120, 130, 4, 126/6, 123, 131, 364, 137, 100, 66, 31, 90 A; 237/51, 55, 19; 219/366, 367, 368, 279, 344, 391, 392; 122/20 B

[56] References Cited

U.S. PATENT DOCUMENTS

| | | | |
|---|---|---|---|
| 803,183 | 10/1905 | Menke | 126/4 |
| 1,178,884 | 4/1916 | Stell | 126/4 |
| 1,189,261 | 7/1916 | Kincaid et al. | 126/121 X |
| 1,988,238 | 1/1935 | Coplen | 126/31 |
| 2,322,016 | 6/1943 | Hardeman | 126/121 X |
| 2,361,644 | 10/1944 | Mueller | 126/6 X |
| 2,620,431 | 12/1952 | Shepheard | 219/279 |
| 3,085,564 | 4/1963 | Weimer | 126/121 |
| 3,175,552 | 3/1965 | Sutton | 126/121 |
| 3,874,364 | 4/1975 | Fauser | 126/121 |
| 4,062,344 | 12/1977 | Mayes | 126/120 |
| 4,076,011 | 2/1978 | Prouly | 219/279 X |
| 4,142,506 | 3/1979 | Morris et al. | 126/31 X |

FOREIGN PATENT DOCUMENTS

| | | | |
|---|---|---|---|
| 846910 | 7/1949 | Fed. Rep. of Germany | 219/279 |
| 33403 | 4/1928 | France | 219/279 |
| 42091 | 5/1924 | Norway | 219/279 |
| 334716 | 9/1930 | United Kingdom | 219/279 |

*Primary Examiner*—Samuel Scott
*Assistant Examiner*—Randall L. Green
*Attorney, Agent, or Firm*—Frost & Jacobs

[57] ABSTRACT

An electric furnace fireplace including a heat exchanging fireplace for burning any type of combustible fuel, and electric heating elements positioned near the fireplace plenum exhaust for operation as an electric furnace. An oven is provided above the fireplace combustion chamber for heating comistibles placed therein. Water contained in a tank overlying the combustion chamber and surrounding the fireplace flue is heated by fuel burned within the combustion chamber or by heating elements within the tank.

4 Claims, 6 Drawing Figures

ELECTRIC FURNACE FIREPLACE

BACKGROUND OF THE INVENTION

1. Field of the Invention.

This invention relates generally to heat exchanging fireplaces, and more particularly to a heat exchanging fireplace having electric heating elements for use as an electric furnace.

2. Description of the Prior Art.

Fireplaces of the heat exchanging type are well known for providing heated air by the burning of fuel such as wood or the like in the fireplace combustion chamber. Some of these fireplaces are designed to heat a single room, while others may be connected to existing heat distribution lines for heating areas remote from the fireplace location.

It has also been proposed to include electric heating elements within the fireplace structure for providing a heating alternative to combustible fuels. However, such structures have heretofor made inefficient use of the electrically produced heat energy, or have been unnecessarily complicated thereby discouraging their use in new heating installations or as replacement units.

SUMMARY OF THE INVENTION

The present invention comprises an electric furnace fireplace including a heat exchanging fireplace for burning any type of combustible fuel such as oil, gas, wood or coal, and electric heating elements positioned near the fireplace plenum exhaust for operation as an electric furnace.

The furnace comprises a forwardly opening fireplace enclosure defining a combustion chamber which includes a lower horizontal surface for supporting the combustible fuel. The side and rear walls of the combustion chamber not only reflects heat within the combustion chamber toward the forward opening, but also acts as heat exchangers to heat air moving through cold air and warm air duct-like plenums adjacent the side and rear walls. The upper end of the combustion chamber terminates in a hollow duct-like flue for exhausting fumes produced by burning fuel within the combustion chamber.

A pair of duct-like air plenums are positioned on either side of the combustion chamber enclosure such that heat produced by burning fuel can heat air moving through the plenums. Each plenum has an inlet located at its upper rear end for introducing air into the plenum, and an outlet located at floor level for exhausting heated air from the plenum to a warm air trunk line for distribution to other parts of a structure to be heated. A separate duct-like air plenum is also positioned adjacent the rear wall of the enclosure, so that air moving through the rear plenum may also be heated by heat transferred from the rear wall of the combustion chamber as a result of fuel burning therein. The rear plenum includes outlets which communicate with the side plenum inlets, as well as an inlet for introducing unheated air into the rear plenum from a cold air return line or the like. The partition separating the rear and side plenums, which also forms a heat exchanger, is structured to provide a circuitous flow path for the air in order to maximize the heat exchanging surface area.

One or more electric heating elements are positioned in either or both of the side plenums adjacent the heated air outlet for operation of the furnace fireplace as an electric furnace. Positioning the heating element near the air exhaust insures that only the air is heated, rather than adjacent parts of the furnace structure, thereby contributing to the overall efficiency of the apparatus. The heating elements are also disposed transversely to the air flow to insure maximum heat transfer area. A damper may also be included within the flue duct to minimize heat loss when the structure is operated as an electric furnace.

The furnace fireplace of the present invention may also include a box-like enclosure forming an oven positioned immediately above the combustion chamber such that heat produced by burning fuel may heat comistibles and the like contained within the oven. A hinged door may also be provided on the oven as required.

A tank for containing water or other fluid is also positioned above the combustion chamber and surrounding the flue duct for heating fluids contained within the tank. The heated fluid, such as water, may be utilized to heat other areas, or for domestic hot water purposes, or as a heat storage medium. The lower surface of the tank is substantially flat to provide maximum heat exchange area to the water from heat produced within the combustion chamber. In addition, the flat lower surface of the tank lies in contact with air moving through the rear and side plenums so that heat stored in the water may be transferred to the air, thus providing full utilization of all heat produced by the fireplace. A supplemental heating element may also be provided within the tank for use as a conventional hot water heater.

DESCRIPTION OF THE PREFERRED EMBODIMENTS

Figure 2:
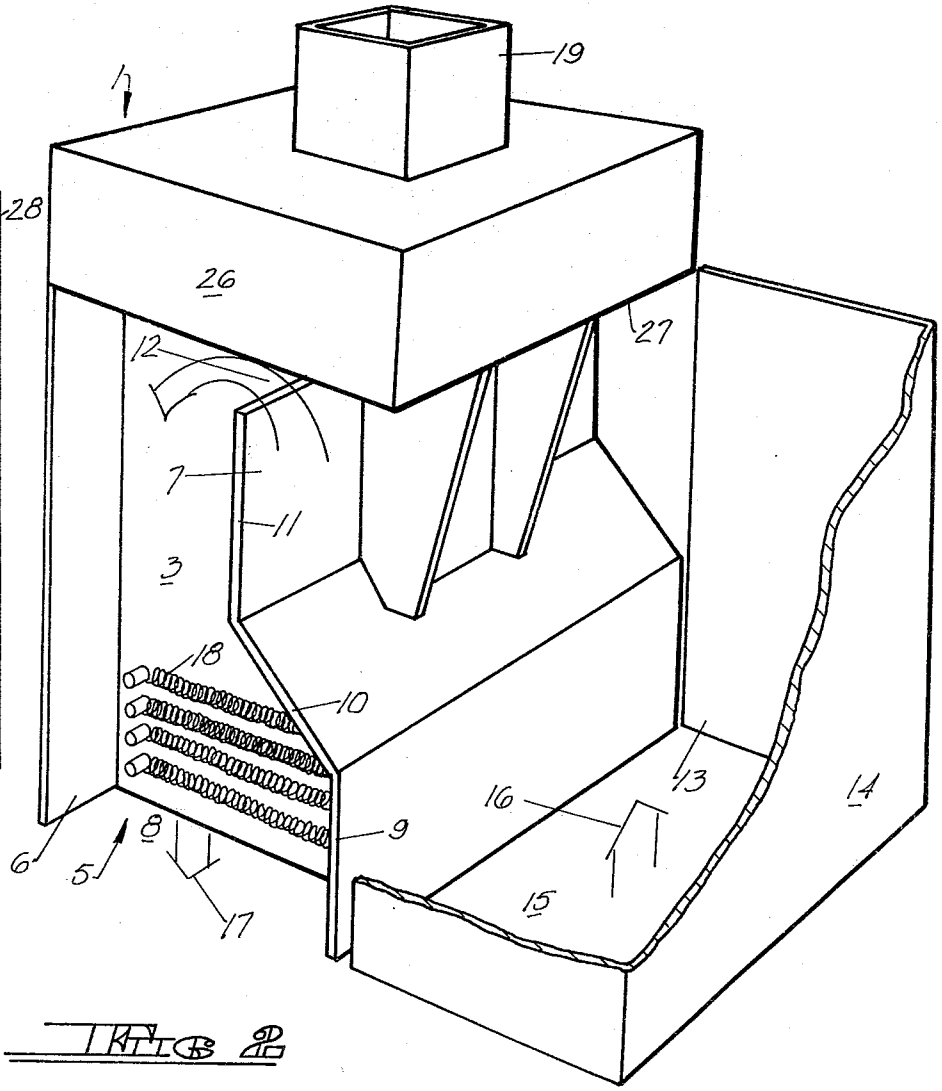
FIG. 2 is a fragmentary exploded rear perspective view of the furnace fireplace of the present invention.
Figure 1:
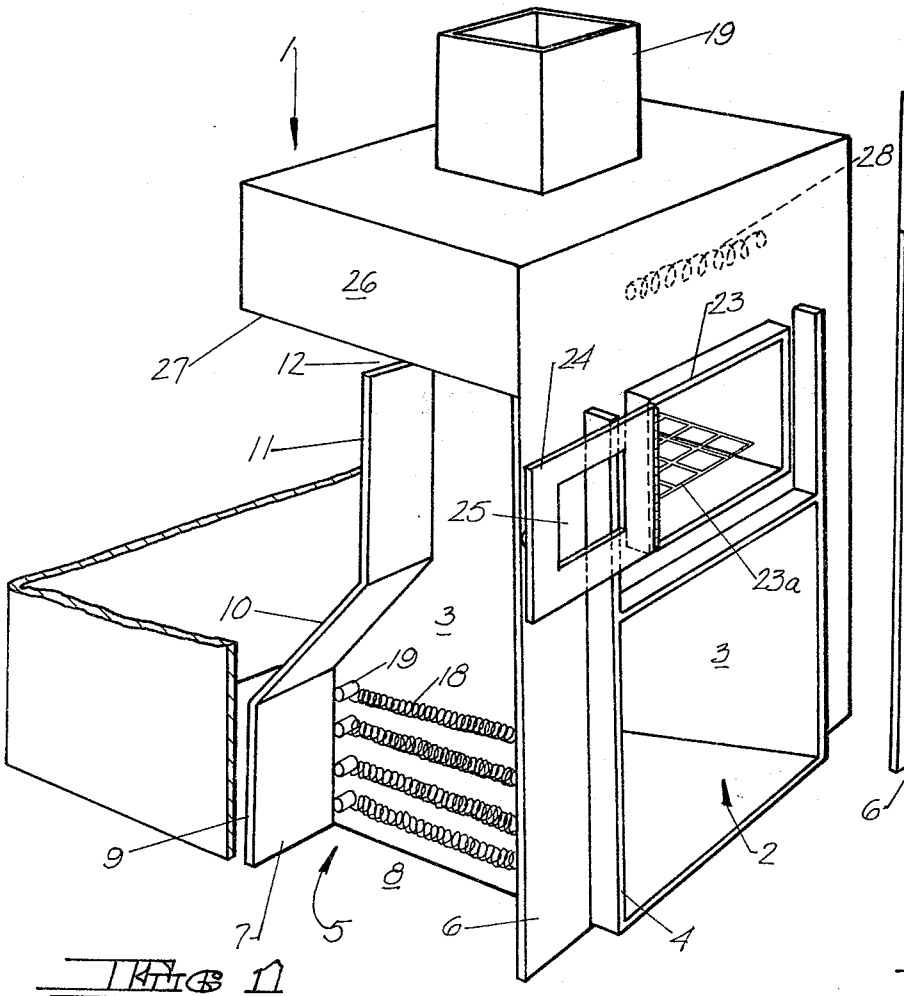
FIG. 1 is a fragmentary exploded front perspective view of the furnace fireplace of the present invention.
Figure 4:
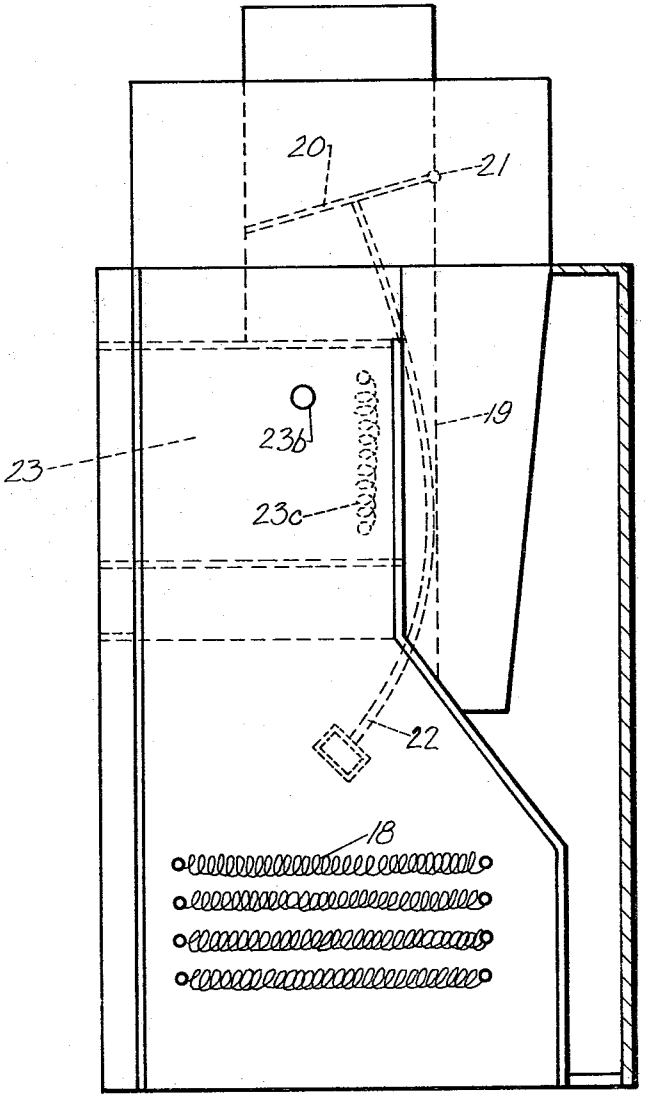
FIG. 4 is a side elevation view, partly in cross section, of the furnace fireplace of the present invention.
Figure 3:
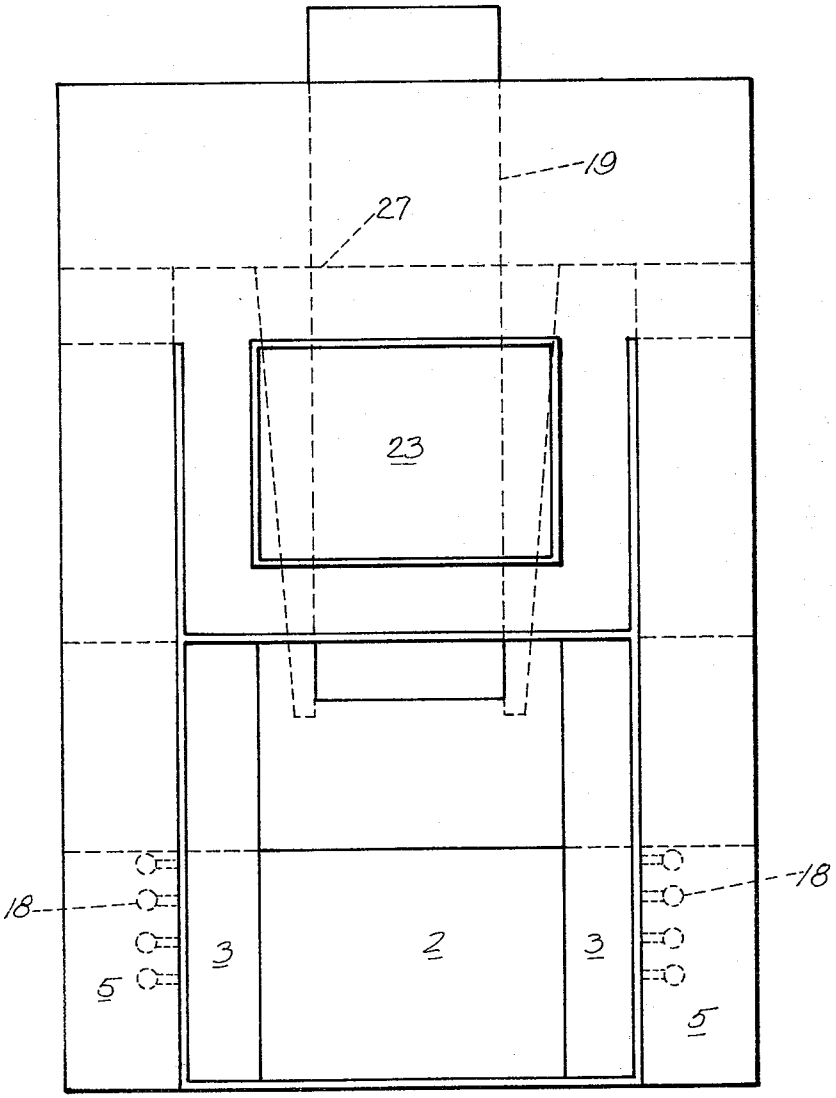
FIG. 3 is a front elevation view of the furnace fireplace of the present invention.
Figure 6:
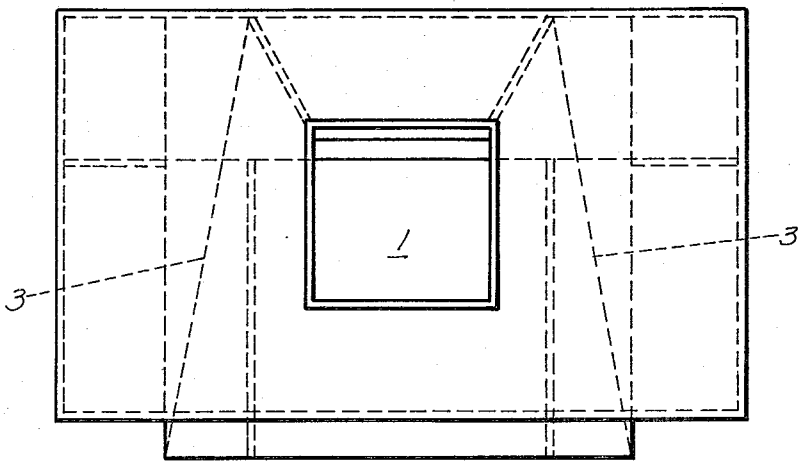
FIG. 6 is a top plan view of the furnace fireplace of the present invention.
Figure 5:
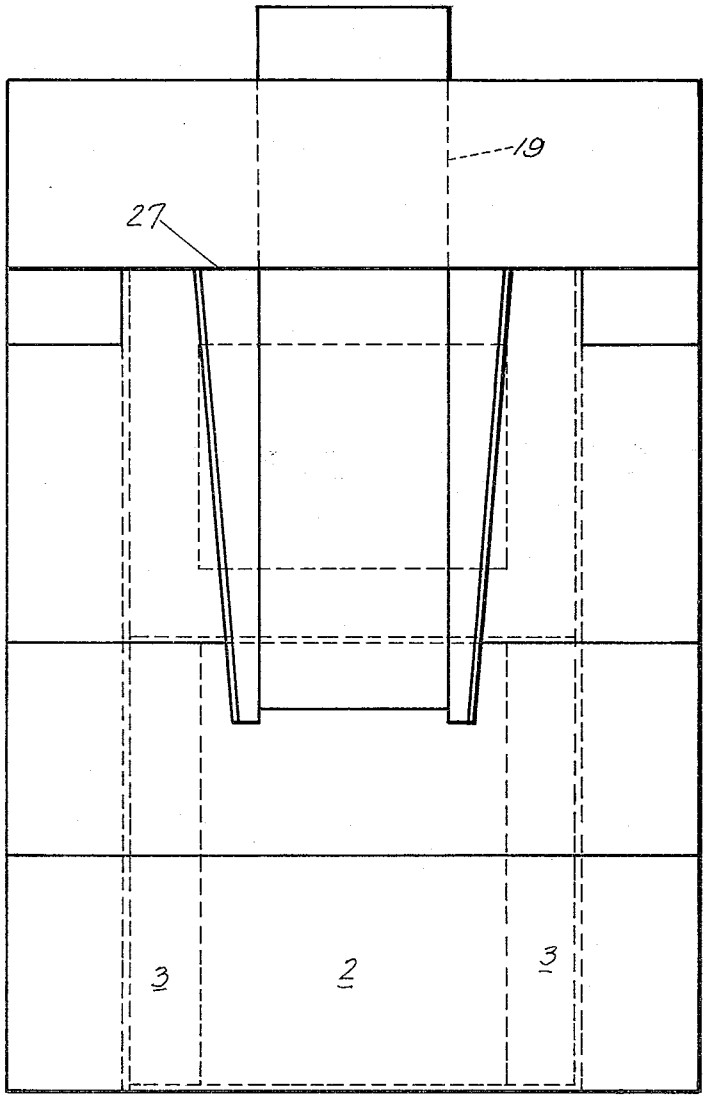
FIG. 5 is a rear elevation view of the furnace fireplace of the present invention.

As shown in the perspective views of FIG. 1 and FIG. 2, the furnace fireplace, shown generally at 1, includes a forwardly opening box-like combustion chamber 2 having a substantially horizontal lower surface for supporting, directly or by means of a raised hearth or grate (not shown), any type of solid fuel such as wood, coal or the like. In addition, means may be included for burning other types of fuel such as gas or oil, as is well known in the art. The side walls forming enclosure 2, one of which is shown at 3, taper rearwardly and inwardly so as to form reflecting surfaces to insure that heat produced within the enclosure is directed outwardly toward the enclosure opening. Side walls 3 are constructed of a heat conducting material, such as cast-iron, steel or the like, thus forming heat exchanging surfaces for air passing over their outside surfaces as will be described hereinafter. The forwardmost edge of enclosure 2 terminates in an outwardly extending lip 4 which can be used for attaching a facade or mantel to the front of the fireplace as desired.

Located on either side of the combustion chamber enclosure 2 is a substantially vertical air plenum 5. Plenums 5 are formed by an outwardly extending vertical flange 6 mounted adjacent the opening of enclosure 2, and an S-shaped substantially vertical flange-like plate 7 spaced from flange 6 and extending outwardly from side wall 3 adjacent the rear wall of enclosure 2. The lower edges of flange 6 and plate 7 are substantially coplanar with the lower horizontal surface of enclosure 2, and define, as will be explained in more detail hereinafter, an outlet 8 for exhausting heated air from the side plenum to a warm air trunk line.

Plate 7 comprises a lower vertical section 9 which is attached at its upper edge to the lower edge of an upperwardly and forwardly extending member 10. The upper edge of member 10 is attached to the lower edge of a vertical member 11. An opening is retained between the upper edge of vertical member 11 and the lower surface of the structure existing thereabove to form an inlet 12 for introducing air into said side plenums, as will be described hereinafter. Flange 6 and plate 7 are constructed of heat conducting materials so that heat produced within combustion chamber 2 will be conducted through side walls 3 to the surfaces of flange 6 and plate 7, thus providing increased heat exchanging surface area for air moving there along. It will be observed that the S-shape of plate 7 provides a circuitous path for air movement to insure maximum heat transfer to the air.

A duct-like air plenum 13 is also positioned adjacent the rear wall of enclosure 2. Plenum 13 is formed by a vertical U-shaped shroud 14 which extend from the outermost edge of plate 6, across side plenum 8, and around the rear of furnace 1 to produce a duct-like opening between the rearmost surface of the rear wall of enclosure 2 and the innermost surface of the rear wall of shroud 14. As illustrated in FIG. 1 and FIG. 2, shroud 14 has been pulled back from the rear of the furnace fireplace for purposes of clarity. It will be observed that the inner surfaces of the side walls of shroud 14 contact the outermost edges of members 9, 10 and 11, thereby providing a closed duct for side plenums 5. It will also be observed that the rear wall of enclosure 2 forms a heat exchanging surface for transferring heat produced within the combustion chamber 2 to air moving through the rear plenum 13. The spacing between the rear wall of enclosure 2 and the inner surface of the rear wall of shroud 14 will be determined by the air flow desired, the amount of heat expected to be produced within the combustion chamber, as well as the mounting space available for the fireplace furnace.

The lower end of plenum 13 forms an inlet 15 for introducing unheated air into rear plenum 13 from a cold air return line or the like (not shown). The unheated air introduced in the direction of arrow 16 flows upwardly along the rear heat exchanging surface of combustion chamber 2, through opening 12, and downwardly through side plenums 5, exhausting at outlet 8 in the direction of arrow 17 to warm air trunk lines or the like (not shown). Air flow may be produced by convection currents, or by a suitable blower located externally of the furnace fireplace as is well understood in the art.

One or more electric heating elements, shown at 18, may be located within either or both side plenums 5, for operating furnace fireplace 1 as an electric furnace. In general, each heating element 18 comprises a horizontally disposed resistance heating element supported at its ends from the outermost surface of wall 3 by a pair of ceramic insulators 19 or the like. The horizontal orientation of heating elements 18 permits the elements to extend completely across the side plenums 5 thereby exposing the maximum surface area to the flow of air through the plenum.

It will also be noted that the heating elements are disposed near outlet 8 of plenum 5 which maximizes the amount of heat energy transferred to the moving air and minimizes the amount of heat energy transferred to other parts of the furnace structure. For example, in some prior art designs the heating elements are located at some distance within the fireplace or furnace structure so that a significant amount of heat energy may be transferred to the enclosure and eventually lost by conduction or radiation. Locating the heating elements near the warm air outlet significantly reduces the amount of heat lost.

The upper end of combustion chamber 2 contains an opening which communicates with a vertical duct-like exhaust flue 19 for conducting exhaust gases from fuel burning within combustion chamber 2 to a chimney or the like, not shown. Flue 19 may also contain a damper 20 hingedly attached to the innerwall of flue 19 such as by hinge 21 which permits closing the flue to prevent escape of heat therefrom when furnace fireplace 1 is operated as an electric furnace. Damper 20 may be actuated by means of a flexible cable 22 extending downwardly within flue 19 into combustion chamber 2. As illlustrated, damper 20 may be closed by pushing upwardly on cable 22, and may be similarly opened by pulling downwardly on cable 22.

Fireplace furnace 1 also contains a box-like enclosure 23 forming an oven overlying combustion chamber 2 such that heat rising from the combustion chamber will warm or cook comistibles and the like placed within the oven. Oven 23 may also be provided with a hinged door 24 containing a transparent window 25. Other accessories, such as shelves **23*a*, steam vent 23*b*, and the like may also be added to oven 23 as required. Furthermore, heating elements, one of which is shown at 23*c*, may be provided wthin oven 23** for use as a conventional cooking oven.

Overlying oven 23 and combustion chamber 2, and surrounding flue 19, is a box-like water tank enclosure 26 capable of holding a quantity of water or other fluid. Water tank 26 includes a substantially flat bottom surface 27 which lies in heat exchanging proximity to air moving through plenum chambers 5 and 15. It will be observed that heat will be transferred to water tank 26 and subsequently to the water contained therein not only by air heated by its passage along the rear surface of combustion chamber 2, but also by heat rising from combustion chamber 2. Furthermore, heat which may escape through flue 19 is also transferred to the walls of the flue which form the inner surfaces of water tank 26 and thereafter to the water contained in the tank. The heated water may be used for space heating purposes in another location, or to fulfill hot water requirements, or as a storage medium for periods when heat is not being produced within combustion chamber 2 or by heating elements 18. In this latter situation, heat retained by the water within tank 26 will be transferred to cooler air moving through rear plenum 15 and side plenums 5. A supplemental electric heating element positioned within tank 26 may also be energized for heating water contained therein for the purposes hereinbefore described. If desired, the inner surface of tank 26 may be coated with a layer of fiberglass or the like to insure water tight integrity. In addition, insulation may be provided around the outside of tank 26 to prevent heat loss therefrom.

It will thus be observed that the furnace fireplace of the present invention provides significant improvements over units presently known. In particular, the furnace fireplace of the present invention which can be built-in or freestanding provides a unitary structure which, because of its compact construction, provides significant space savings in applications where such units have not heretofore been available, such as trailers, camping trailers and vacation homes. The exposed surfaces of the structure may be provided with any desired finish such as cast-iron, porcelain or the like, to match a particular decor.

It will be understood that various changes in the detailed materials, steps and arrangements of parts, which have been herein described and illustrated in order to explain the nature of the invention, may be made by those skilled in the art within the principal and scope of the invention as expressed in the appended claims.

The embodiments of the invention in which exclusive property or privilege is claimed are as follows:

1. An electric furnace fireplace comprising:

(a) A combustion chamber defining a forwardly opening fireplace enclosure having a lower horizontal surface for supporting combustible fuel, the side and rear walls of said enclosure defining heat exchange and reflecting means for reflecting heat within said enclosure toward said forward opening and for transferring heat to adjacent air plenums;

(b) Flue means comprising a hollow duct extending generally upperwardly from said enclosure for exhausting fumes produced by burning fuel within said enclosure;

(c) A pair of duct-like air plenums positioned on either side of said enclosure, said heat exchange means formed by said side walls of said enclosure being operative to transfer heat from fuel burned within said enclosure to air moving through said side plenums, each of said side plenums having an inlet for introducing air into said side plenum and an outlet for exhausting heated air from said side plenum to a warm air trunk line.

(d) A duct-like air plenum positioned adjacent the rear wall of said enclosure, said heat exchange means formed by said rear wall of said enclosure being operative to transfer heat from fuel burned within said enclosure to air moving through said rear plenum, said rear plenum including outlets communicating with said side plenum inlets, and an inlet for introducing unheated air into said rear plenum from a cold air return line;

(e) At least one electric heating element positioned within at least one of said side plenums adjacent said heated air outlet for heating air moving through said plenums;

(f) A flat-bottomed water tank surrounding said flue and positioned above said enclosure such that heat produced within said enclosure by burning fuel and exhausted through said flue operates to raise the temperature of said tank bottom and the portion of said tank adjacent said flue for heating water contained within said tank; and (g) An electric heating element contained within said tank for heating water therein.

2. The furnace fireplace according to claim 1 wherein said fireplace includes a box-like enclosure having a forward opening therein forming an oven and placed in an upper portion of said fireplace enclosure such that heat produced within said fireplace enclosure by burning fuel may be transferred to said oven for heating comistibles and the like placed therein, said oven including a door hingedly mounted proximate said oven opening.

3. The furnace fireplace according to claim 2 including at least one heating element disposed within said oven.

4. The furnace fireplace according to claim 1 including a partition separating said side and rear plenums, said partition being attached in heat conducting relationship to said enclosure for transferring heat to air moving there along, said partition having a shape so as to force air moving from said rear plenum toward said side plenum in a circuitous path.

* * * * *